US008584712B2

(12) United States Patent
Ballu et al.

(10) Patent No.: US 8,584,712 B2
(45) Date of Patent: Nov. 19, 2013

(54) STATION AND A METHOD FOR RELOADING A MOBILE SPRAYER WITH COATING MATERIAL

(75) Inventors: Patrick Ballu, Reims (FR); Thierry Buquet, Allevard (FR); Cédric Le Strat, Fontaine (FR); Eric Prus, Grenoble (FR); Hervé Walter, Saint Bernard du Touvet (FR)

(73) Assignee: Sames Technologies, Meylan (FR)

( * ) Notice: Subject to any disclaimer, the term of this patent is extended or adjusted under 35 U.S.C. 154(b) by 258 days.

(21) Appl. No.: 13/133,205

(22) PCT Filed: Dec. 8, 2009

(86) PCT No.: PCT/FR2009/052453

§ 371 (c)(1),
(2), (4) Date: Jun. 30, 2011

(87) PCT Pub. No.: WO2010/067015

PCT Pub. Date: Jun. 17, 2010

(65) Prior Publication Data

US 2011/0259431 A1 Oct. 27, 2011

(30) Foreign Application Priority Data

Dec. 9, 2008 (FR) ..... 08 58415

(51) Int. Cl.
*B05B 5/16* (2006.01)
*B65B 29/00* (2006.01)
*B65B 3/04* (2006.01)

(52) U.S. Cl.
USPC ..... 141/3; 141/20.5; 141/27; 141/89; 141/94; 141/104; 901/43; 118/323; 427/427.3

(58) Field of Classification Search
USPC ..... 141/94–95, 20.5, 25, 27, 67, 104, 89, 141/302, 3, 2; 901/43; 118/302, 323; 427/427.3
See application file for complete search history.

(56) References Cited

U.S. PATENT DOCUMENTS 4,785,760 A 11/1988 Tholome
5,772,125 A * 6/1998 Ehinger et al. ..... 239/694
6,702,893 B2 * 3/2004 Thome et al. ..... 118/302

(Continued)

FOREIGN PATENT DOCUMENTS

EP 0274322 B1 9/1990
EP 1 071 518 B1 9/2004

(Continued)

OTHER PUBLICATIONS

International Search Report for PCT/FR2009/052453; Dated Feb. 16, 2010.

*Primary Examiner* — Timothy L Maust
*Assistant Examiner* — Timothy P Kelly
(74) *Attorney, Agent, or Firm* — Robert M. Gould; Husch Blackwell LLP

(57) ABSTRACT

A station for reloading a sprayer is disclosed that includes a tank coupled to at least one coating material circuit by a coupler, a docking unit that is adapted to receive a sprayer; and at least one accumulator having a volume that is greater than or equal to the volume of the tank. Each accumulator is connected to at least one circuit by the coupler. The station also includes a mechanism for pressurizing the accumulator. The accumulator is connected to the docking unit which is, in turn, connected to the tank.

13 Claims, 5 Drawing Sheets

(56) References Cited

U.S. PATENT DOCUMENTS

| | | | | |
|---|---|---|---|---|
| 6,989,176 | B2 * | 1/2006 | Congard et al. | 427/427.2 |
| 8,042,579 | B2 * | 10/2011 | Matsumoto | 141/94 |
| 8,201,585 | B2 * | 6/2012 | Nomura et al. | 141/20.5 |
| 2007/0082143 | A1 | 4/2007 | Baumann | |
| 2011/0277686 | A1 * | 11/2011 | Walter et al. | 118/302 |

FOREIGN PATENT DOCUMENTS

| | | | |
|---|---|---|---|
| FR | 2777482 | A | 10/1999 |
| FR | 2815554 | A | 4/2002 |
| FR | 2890876 | A | 3/2007 |
| WO | 01/15814 | A1 | 3/2001 |

* cited by examiner

STATION AND A METHOD FOR RELOADING A MOBILE SPRAYER WITH COATING MATERIAL

RELATED APPLICATIONS

The present application is a §371 U.S. national stage entry of International Application No. PCT/FR2009/052453, filed Dec. 8, 2009, which claims the priority of France patent application No. 08 58415 filed Dec. 9, 2008, all of which are incorporated herein by reference in its entirety.

FIELD

The present invention relates to a station and to a method for re-supplying a coating material to at least one atomizer equipped with a reservoir and disposed on a robot mounted to move relative to articles to be coated.

BACKGROUND

EP-A-0 274 322 describes a spraying installation for spraying a coating material onto articles to be coated, such as motor vehicle bodies. The term "coating material" is used to mean any material that is to be sprayed onto an article to be coated, e.g. a primer, a paint, or a varnish, etc. A station is used to re-supply coating material to an atomizer equipped with a reservoir and disposed on a robot mounted to move relative to motor vehicle bodies. That station includes coupling means for coupling to coating material circuits. The coupling means are formed by connector elements, each of which is mounted at the end of a respective coating material circuit. Each coating material circuit makes it possible, when selected, to feed the reservoir equipping the atomizer.

The re-supply station described by EP-A-0 274 322 also includes a docking unit defining an atomizer-receiving zone for receiving the atomizer equipped with its reservoir. After a stage of spraying on the articles to be coated, in order to re-supply the atomizer and its reservoir with coating material, the robot comes to place the atomizer in the atomizer-receiving zone. Then the reservoir is connected to the circuit of the coating material that is to be transferred to the reservoir, via corresponding coupling means of the docking unit. After the reservoir has been filled, the robot resumes moving the atomizer facing the articles to be coated.

When the coating material is to be changed, e.g. when the shade of paint is to be changed, then, prior to filling, the atomizer and its reservoir must be rinsed with a cleaning material. To that end, the re-supply station described by EP-A-0 274 322 also includes another connector element performing the function of coupling member for coupling to a cleaning material duct. The term "cleaning material" is used to mean any solvent adapted to remove the coating material from the surfaces of the reservoir and of the atomizer.

Prior art stations and methods take a relatively long time to change coating materials because the pressure in conventional circuits is generally limited to 6 bars, thereby resulting in a flow rate for filling the reservoir that is limited to 3000 cubic centimeters per minute ($cm^3$/min). Thus, re-supply lasts about 20 seconds for a reservoir of 400 $cm^3$, including 10 seconds for docking the atomizer and for connecting the reservoir to the docking unit. In an installation for painting motor vehicle bodies, such a re-supply station and such a re-supply method make it possible to coat no more than 50 vehicles per hour.

In addition, in order to limit settling-out of a coating material, in particular of a paint, when it stagnates in a circuit of a paint installation as described by WO-A-01 015 814, each coating material circuit must be made up of two distinct paths for causing the coating material to flow regularly. A "go" path brings the coating material from a pump to the coupling means of the station, while a "return" path brings the coating material back from the coupling means to the pump. Unfortunately, the costs of manufacturing, assembling, and maintaining such two-path circuits are relatively high.

A particular object of the invention is to remedy those drawbacks by proposing a station that makes fast re-supply possible, that is of simple construction, and that limits wastage and settling-out of the coating materials.

SUMMARY

To this end, the invention provides a station for re-supplying coating material to at least one atomizer equipped with at least one reservoir and disposed on a robot that is mounted to move relative to the articles to be coated.

The station includes:

- coupling means for coupling to at least one coating material circuit; and
- a docking unit defining an atomizer-receiving zone for receiving at least one atomizer.

The station further includes:

- at least one accumulator having a volume greater than or equal to the volume of the reservoir, the or each accumulator being adapted to be connected to at least one respective coating material circuit via the coupling means;
- pressurizing means for putting the volume of the accumulator under pressure;
- connection means for connecting the or each accumulator to the docking unit; and
- a connection member for connecting the docking unit to the reservoir.

According to other advantageous but optional characteristics of the invention, taken in isolation or in any technically feasible combination:

- the station includes a versatile accumulator connected to a plurality of circuits via coupling means that include a coating material change block, the versatile accumulator being connected firstly to the coating material change block and secondly to the docking unit;
- the station includes a plurality of accumulators, each of which is connected to a respective circuit via distinct coupling means, the connection member including, for each accumulator, a head valve configured for being connected to the atomizer;
- the station further includes at least one coupling member for coupling to at least one cleaning material duct, and the docking unit further includes a device for rinsing the outside surfaces of the atomizer, the device being connected to the cleaning material duct via the coupling member, the device being mounted to move between a plurality of positions corresponding to the respective head valves.
- the versatile accumulator is dedicated to the coating materials that are used least often, while each other accumulator is dedicated to a coating material that is used more often;
- the or each accumulator operates reversibly, so that it can transfer coating material either towards the docking unit or towards the coupling means for coupling to the corresponding circuit;
- the pressurizing means comprise a coupling and a respective thrust chamber belonging to the or to each accumulator, the thrust chamber being designed to be put under pressure in such a manner as to expel coating material from the corresponding accumulator, the coupling being adapted to connect the thrust chamber to a compressed air duct;

the pressurizing means comprise a respective piston belonging to the or each accumulator, the piston defining the thrust chamber and being mounted to move in translation in the corresponding accumulator; and the station further includes at least one pressure sensor for regulating the pressure prevailing in the or each accumulator and in the connection means.

The present invention also provides a method of re-supplying coating material to at least one atomizer equipped with at least one reservoir and disposed on a robot that is mounted to move relative to articles to be coated.

The method uses a station including:

a docking unit defining an atomizer-receiving zone for at least one atomizer;

at least one accumulator having a volume greater than or equal to the volume of the reservoir, the or each accumulator being adapted to be connected to at least one respective coating material circuit via coupling means;

connection means for connecting the or of each accumulator to the docking unit; and a connection member for connecting the docking unit to the reservoir.

The method comprises the following steps:

a) filling the or each accumulator with coating material via the coupling means;

b) pressurizing the volume of the accumulator;

c) placing the atomizer in the atomizer-receiving zone;

d) connecting the reservoir to the docking unit;

e) transferring the coating material from one of the accumulators to the docking unit so as to fill the reservoir.

According to other advantageous but optional characteristics of the invention, taken in isolation or in any technically feasible combination:

the filling step e) consists in:

f) isolating the accumulator from the circuit by closing off the coupling means; and in g) performing the transfer at a transfer flow rate lying in the range 4000 $cm^3$/min to 6000 $cm^3$/min, the accumulator being put under a transfer pressure greater than the filling pressure prevailing in the circuit, the transfer pressure lying in the range 10 bars to 30 bars, and preferably being equal to 15 bars;

the method further comprises the following steps:

h) prior to the placement step b), positioning a device for cleaning the outside surface of the atomizer at a head valve corresponding to the accumulator serving to perform the transfer step d); and i) essentially during the coupling step c) and during the transfer step d), rinsing the outside surfaces of the atomizer by means of the device;

the method further comprises the following steps:

j) connecting the accumulator to the respective circuit by opening the coupling means; and k) returning into the corresponding circuit the coating material contained in an accumulator, after a length of time determined so as to limit settling-out of the coating material.

The invention can be well understood and its advantages also appear from the following description, given merely by way of non-limiting example and with reference to the accompanying drawings, in which:

FIGURES

DETAILED DESCRIPTION

Figure 1:
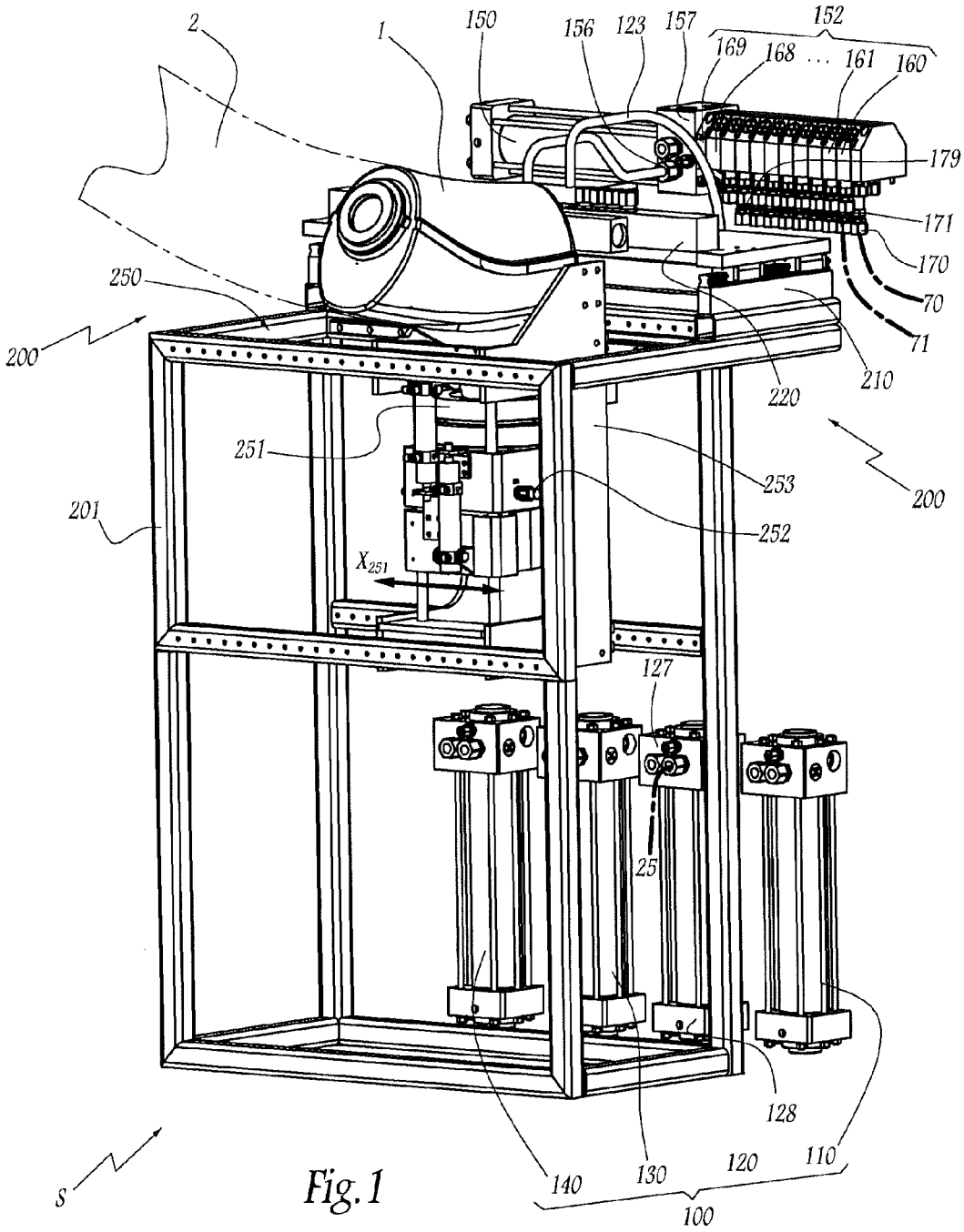
FIG. 1 is a perspective view of a station of the invention.
Figure 2:
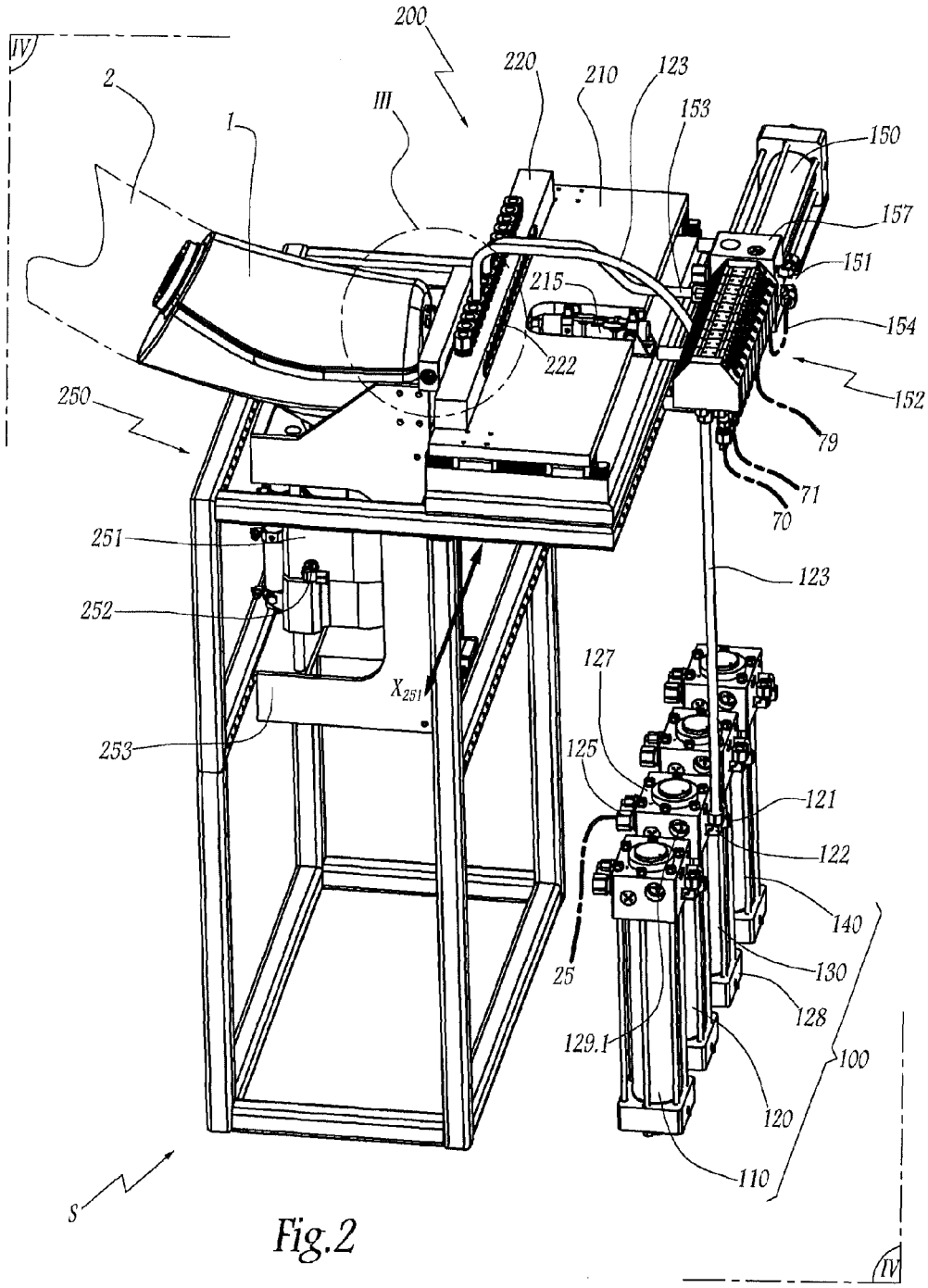
FIG. 2 is a perspective view from a different angle of the station of FIG. 1.
Figure 3:
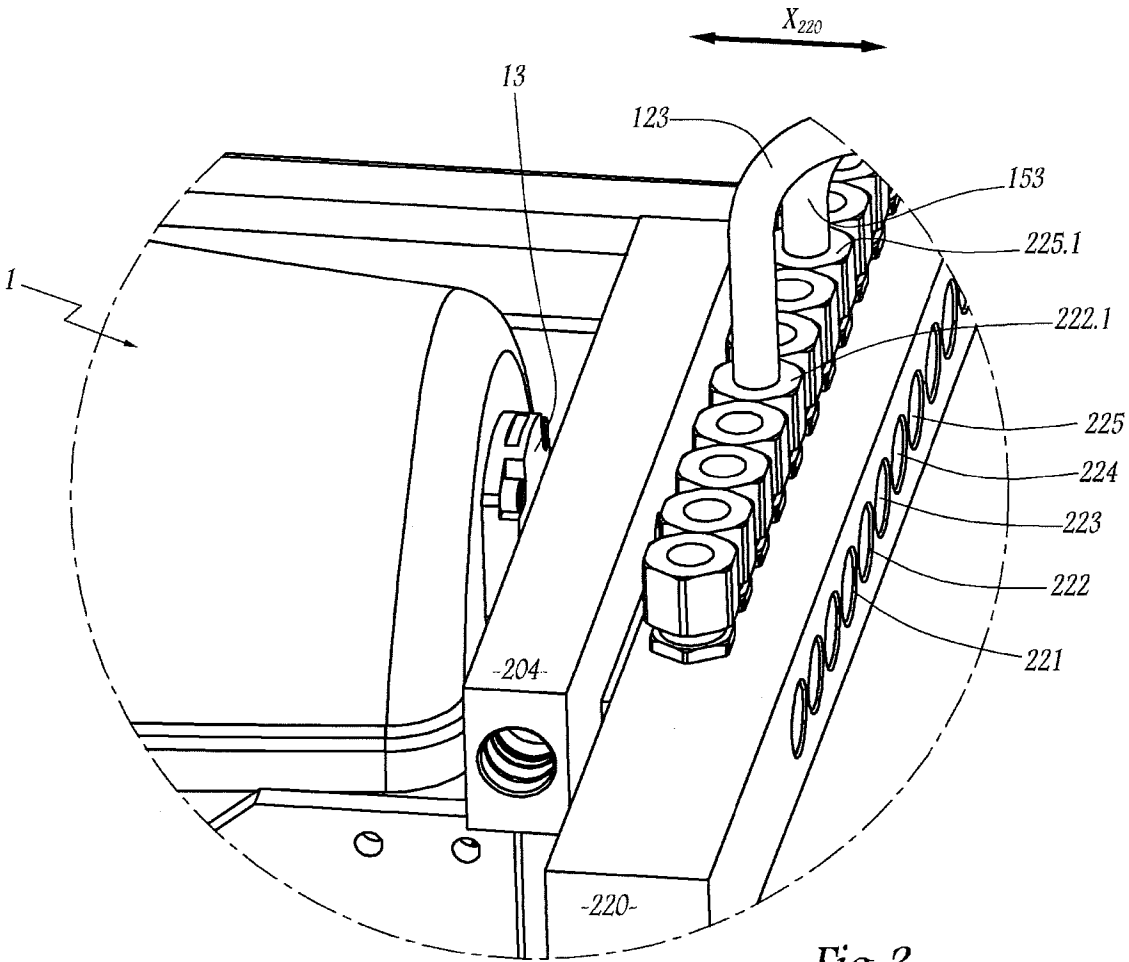
FIG. 3 is a view on a larger scale of detail III in FIG. 2.

FIG. 1 shows a station S including a docking unit 200 that defines an atomizer-receiving zone 250 for receiving an atomizer 1. The atomizer 1 is carried by a robot 2, the casing of which is shown in chain-dotted lines. The robot 2 is mounted to move in such a manner as to move the atomizer 1 relative to the articles to be coated, which articles may be vehicle bodies moved by a conveyor, as shown in FIGS. 1 to 3 of EP-A-0 274 322.

The atomizer 1 is equipped with a reservoir 10 that is said to be "internal" because it is incorporated in a body 11 defining the outer casing of the atomizer 1. When the atomizer 1 is in the atomizer-receiving zone 250, the station S can re-supply the reservoir 10 with coating material.

The docking unit 200 includes a frame 201 and a deck 210 mounted at the top of the frame 201. The frame 201 and the deck 210 support some of the components of the docking unit 200 and some other components of the station S.

The station S also includes five accumulators 110, 120, 130, 140, and 150 that are stationary relative to the station S. The accumulators 110, 120, 130, 140, and 150 have identical structures, so that only the structure of the accumulator 120 is described in detail below. The description given below of the accumulator 120 and of its peripheral components can be transposed directly to the accumulators 110, 130, 140, and 150, with the exception of the differences explicitly mentioned on the subject of the accumulator 150.

The accumulators 110, 120, 130, and 140 are disposed in the bottom portion of the frame 201, while the accumulator 150 is mounted close to the deck 210. Each accumulator 110, 120, 130, 140, and 150 has a body that is essentially tubular in shape with a circular base. The accumulators 110, 120, 130 and 140 extend vertically and in juxtaposed manner, while the accumulator 150 extends horizontally. The accumulators 110, 120, 130, and 140 thus form a set of accumulators 100. Each accumulator 110, 120, 130, 140, or 150 is made of an electrically conductive material, e.g. of metal, and it is grounded, i.e. it is taken to ground potential, by means of conductor wires or of fastening screws (not shown), so as to ensure operator safety.

Figure 4:
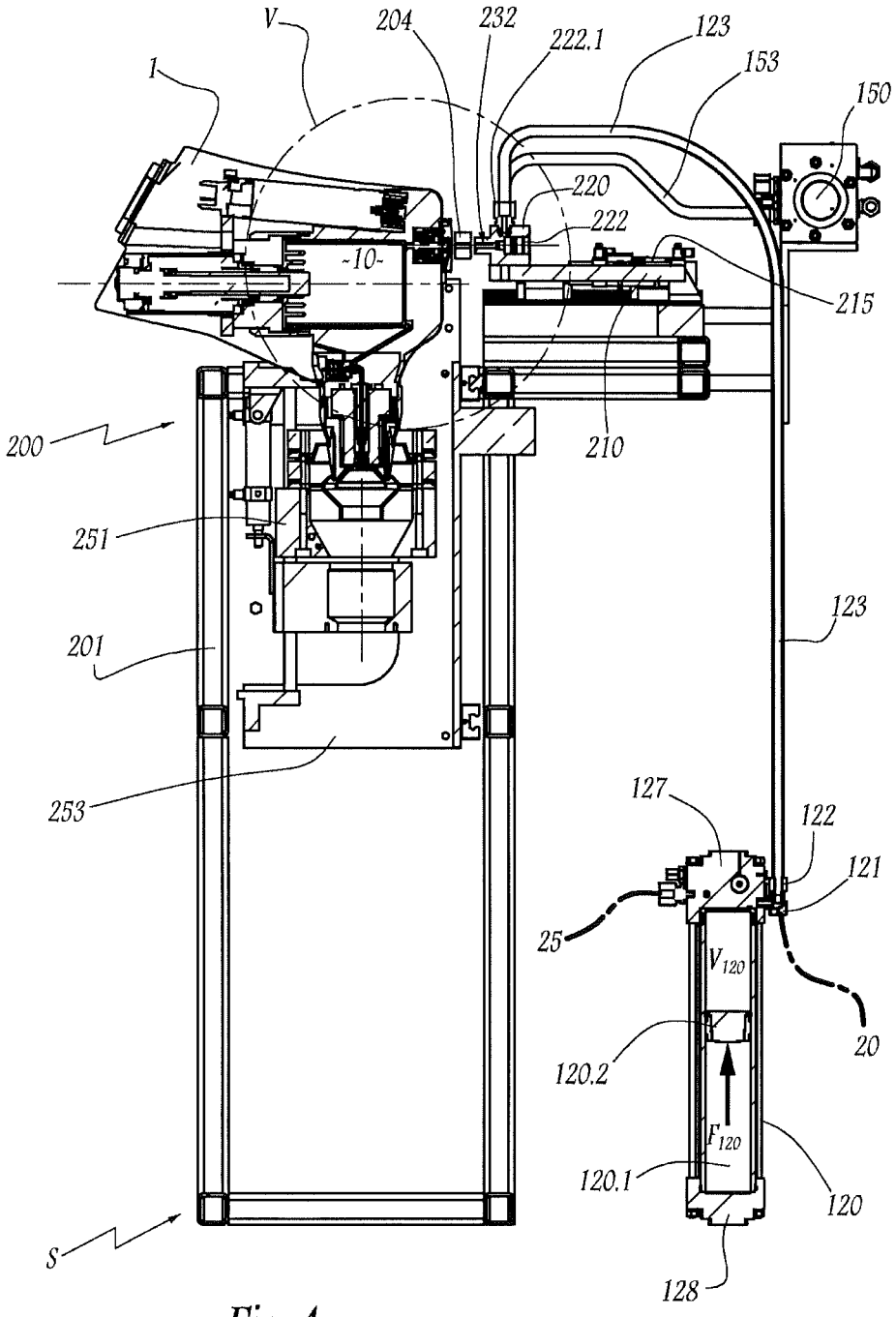
FIG. 4 is a section view on plane IV of FIGS. 2.

As shown in FIG. 4, the tubular body of the accumulator 120 has a volume $V_{120}$ that is defined at its two ends by respective end plates 127 and 128. The accumulator 120 is connected to a circuit 20 that is represented as a chain-dotted line in FIG. 4, and that contains a coating material, namely liquid paint of a determined shade of color in this example. The accumulator 120 is connected to the circuit 20 via a coupling 121 to which the end-piece of the circuit 20 is fastened. The coupling 121 forms coupling means for coupling the accumulator 120 to the circuit 20.

In the present patent application, the terms "interconnect", "connect", and "couple" refer to fluid communication, i.e. to a link enabling a gaseous or liquid fluid to flow or to circulate between two or more points or parts. Such a link may be direct or indirect, i.e. formed by a duct, by a pipe, or by a channel etc.

Similarly, the nouns derived from these verbs, such as "interconnection", "connection", and coupling, concern such fluid communication.

Like the accumulator 120, each accumulator 110, 120, 130, and 140 is connected to a respective paint circuit, not shown, such as the circuit 20 via respective couplings that are visible in FIG. 2 but that are not referenced therein. In other words, each accumulator 110, 120, 130, or 140 may be dedicated to a paint of a determined shade.

The prime function of the circuit 20 is to feed the accumulator 120 with paint. Such a circuit is usually referred to as a "circulating" circuit. The circuit 20 may be formed by a hose, in which case the paint is subjected to a pressure of about 6 bars by a pump (not shown). The circuit 20 belongs to the paint spraying installation in the same way as the station S does.

In addition, the accumulator 120 is connected to the docking unit 200 by connection means that comprise a coupling 122, a pipe 123, and a coupling 222.1. The coupling 122 is fastened in the end plate 127. The coupling 222.1 is fastened in a base 220 belonging to the docking unit 200. The pipe 123 extends between the couplings 122 and 222.1.

The base 220 is disposed on the deck 210 close to the atomizer-receiving zone 250. As shown in FIG. 3, the base 220 is provided with a plurality of juxtaposed head valves, including the head valves 221, 222, 223, 224, and 225 that correspond to respective ones of the accumulators 110, 120, 130, 140, and 150. Each valve 221, 222, 223, 224, or 225 has a conventional structure and it is driven by pneumatic members (not shown). Alternatively, each valve 221, 222, 223, 224, or 225 may be configured to be driven by the atomizer 1, either mechanically or by means of a pneumatic drive, thereby making it possible to open the respective valve 221, 222, 223, 224, or 225 only after the atomizer 1 has been connected.

Figure 5:
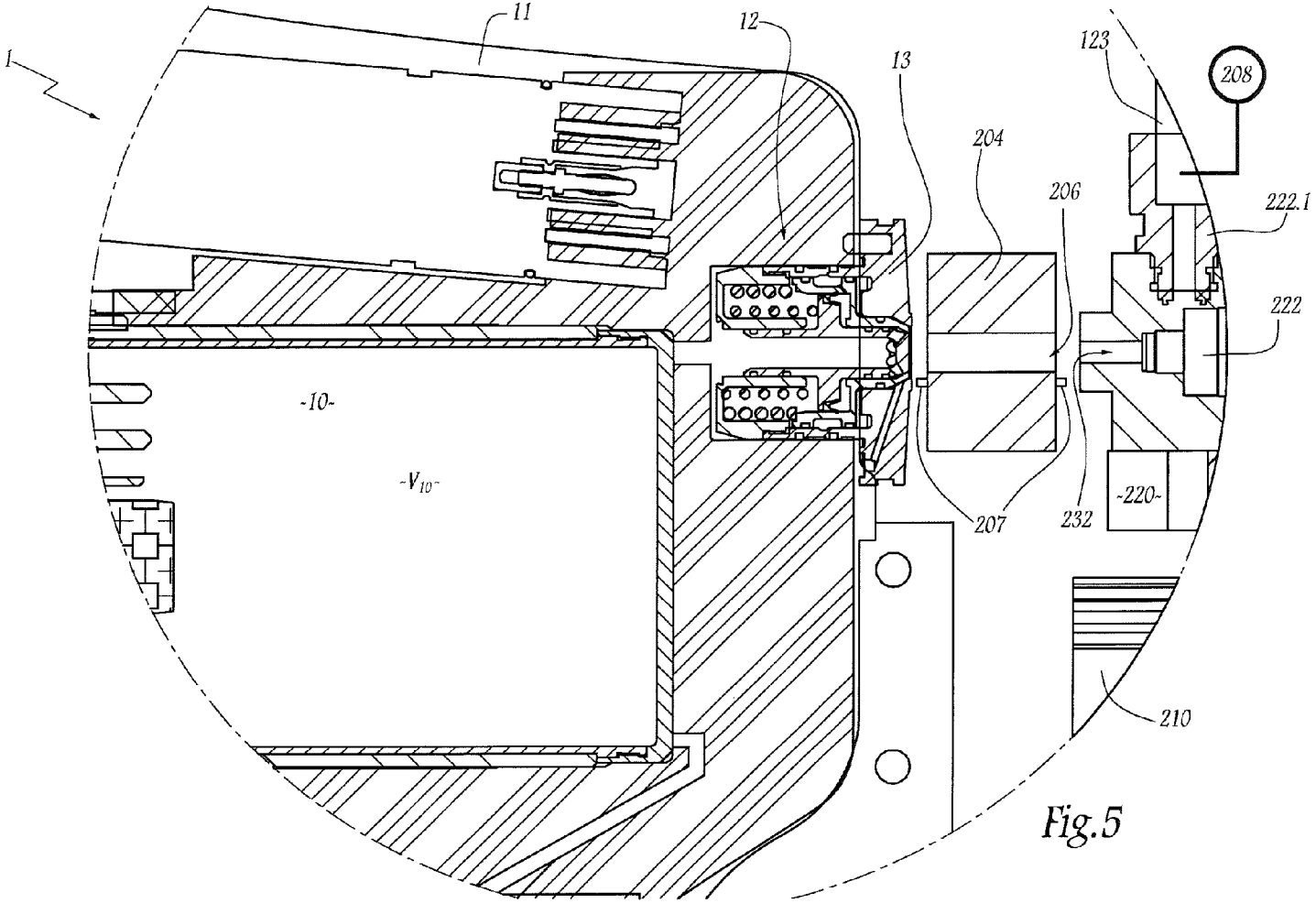
FIG. 5 is a view on a larger scale of detail V in FIG. 4.

As shown in FIG. 5 the head valve 222 controls the flow of material into an outlet channel 232, i.e. it allows material to flow into said outlet channel or it prevents material from flowing into said outlet channel. The outlet channel 232 is defined in the base 220 in which it forms the downstream end of the docking unit 200, and thus of the station S. Each head valve 221, 222, 223, 224, or 225 forms a connection member for connecting the docking unit to the reservoir 10. In practice, the head valve 222 or equivalent connects an outlet channel 232 or equivalent of the base 220 to the reservoir 10 via the atomizer 1. In order to re-supply its reservoir 10, the atomizer 1 must be connected to an outlet channel 232 or equivalent. The selected outlet channel is the outlet channel that corresponds to the required shade of paint.

In the present patent application, the terms "downstream" and "upstream" are used with reference to the direction of flow of the fluid, coating material, compressed air, or cleaning material.

Unlike the accumulators 110, 120, 130, and 140, the accumulator 150 is connected to a plurality of circuits 70 to 79 that circulate various different coating materials which, in this example, are paints of various different shades. The paint circuits 70 to 79 are shown in chain-dotted lines in FIGS. 1 and 2. The accumulator 150 is connected to the circuits 70 to 79, in particular via a coating material change block 152. The block 152 has a conventional structure and conventional functions.

As shown in FIG. 1, the block 152 is made up of a juxtaposition of a plurality of elementary modules 160 to 169, with one elementary module 160 to 169 per circuit 70 to 79. A respective coupling 170 to 179 is connected to each elementary module 160 to 169. The end-pieces of the paint circuits 70 to 79 are fastened in respective ones of the couplings 170 to 179. The coupling means for coupling the accumulator 150 to the paint circuits 70 to 79 comprise the block 152 and the couplings 170 to 179.

These coupling means also comprise a coupling 151 fastened in an end plate 157 mounted at one end of the accumulator 150. The coupling 151 is connected to the block 152 via a pipe 154 that is shown as a chain-dotted line in FIG. 2.

In addition, as shown in FIGS. 1, 2, and 4, the accumulator 150 is connected to the base 220 via connection means that comprise:

- a coupling 156 fastened in the end plate 157;
- a coupling 225.1 fastened in the base 220 and analogous to the coupling 222.1; and
- a pipe 153 that extends between the couplings 156 and 225.1.

Since the accumulator 150 is connected to a plurality of paint circuits 70 to 79, it is said to be "versatile". In other words, the accumulator 150 is not dedicated to any one specific paint, but rather it is dedicated to a plurality of distinct paints of various different shades of color. The accumulator 150 is dedicated to paints that are used least often, whereas each accumulator 110, 120, 130, or 140 is dedicated to a shade of paint that is used more often. In other words, the accumulator 150 is dedicated to "rare" shades, whereas each accumulator 110, 120, 130, or 140 is dedicated to a "main" shade.

In addition, the docking unit 200 includes a device 251 for rinsing the outside surfaces of the atomizer 1. The device 251, which is known per se, is connected to a cleaning material duct (not shown) via a coupling member or coupling 252 that is visible in FIG. 1. The atomizer-receiving zone 250 comprises the top rectangular opening in the frame 201, through which opening a portion of the atomizer 1 can pass so as to penetrate into the device 251. In addition, the device 251 is connected to a compressed air duct (not shown) in such a manner as to dry the previously injected cleaning material.

The device 251 is mounted on a carriage 253 that is mounted to move in translation relative to the frame 201, as indicated by the doubled-headed arrow $X_{251}$, by means of an actuator (not shown). The device 251 is thus movable between positions corresponding to the body 11 of the atomizer 1 being aligned with each respective head valve 221, 222, 223, 224, or 225. In addition, the docking unit 200 includes a jack 215 configured to move the deck 210, and thus the base 220, in translation as indicated by the double-headed arrow $X_{220}$ in such a manner as to connect the base 220 and the atomizer 1 to each other and to disconnect them from each other.

As shown in FIGS. 2 and 3, the docking unit 200 further includes a plate 204 that is secured to the docking unit 200. When the atomizer 1 is connected, the plate 204 is situated facing the distal end of the atomizer 1. The plate 204 is fastened to the carriage 253, so that it is also movable in translation relative to the frame 201 as indicated by the double-headed arrow $X_{251}$. The adjective "distal" designates an element of the atomizer 1 that is relatively far away from the robot 2, while the adjective "proximal" designates an element that is closer thereto.

The plate 204 is provided with a through orifice 206. The plate 204 has a lug 207 on each of its faces so as to guide the atomizer 1 and the base 220 into leaktight contact. The plate 204 serves as a interface between the atomizer 1 and the docking unit 200, and more precisely between the atomizer and each head valve 221, 222, 223, 224, or 225.

While the docking unit 200 is being connected to the atomizer 1 and to its reservoir 10, firstly the actuator 215 moves the deck 210 until the base 220 and the plate 204 come into contact with each other. The plate 204 and the head valve 222 are put into leaktight contact by moving relative to each other, it being possible for this relative movement to be achieved in translation by the robot 2 and/or by the actuator 215. When one of the lugs 207 has penetrated into a bore corresponding to the head valve 222, the outlet channel 232 is connected to the orifice 206.

Secondly, the robot 2 places the atomizer 1 close to the plate 204. A valve 12 is incorporated into the atomizer 1 in order to control re-supplying the reservoir 10. The plate 204 and the distal portion 13 of the valve 12 are put into leaktight contact by relative movement that can be achieved in translation by the robot 2 and/or by the actuator 215.

Each accumulator 120 or equivalent includes a piston 120.2 and a thrust chamber 120.1. The piston 120.2 is mounted to move in translation inside the accumulator 120. The thrust chamber 120.1 is defined by the piston 120.2 and by the walls of the accumulator 120. The paint is contained in the chamber, referenced $V_{120}$, that is defined by the piston 120.2 and that is situated above the thrust chamber 120.1. In a variant, the thrust chamber 120.1 may be placed above the chamber containing the paint. The thrust chamber 120.1 is designed to be put under pressure so as to exercise a thrust force $F_{120}$ on the piston 120.2, in such a manner as to expel the paint from the accumulator 120.

In order to increase the pressure in the thrust chamber 120.1, a thrust fluid, which is compressed air in this example, is delivered via the air duct 25. The air duct 25 is connected to the end plate 127 via a coupling 125, and then to the end plate 128 via a duct and via a coupling that are not shown. The thrust fluid flows from the duct 25 into the coupling 125, and then into the end plate 127, before being injected into the thrust chamber 120.1, via the duct and the coupling that are not shown. Alternatively, a coupling of type 125 may be mounted directly on the end plate 128.

A pneumatic distributor valve (not shown), such as a three-port valve, controls intake of compressed air into the thrust chamber 120.1, via the air duct 25. This pneumatic distributor valve also controls discharge of compressed air from the thrust chamber 120.1, preferably to the atmosphere, so as to reduce the thrust force $F_{120}$ to zero, thereby making it possible to fill the accumulator 120 with paint.

Each accumulator 110, 120, 130, 140, or 150 operates reversibly, i.e. it can transfer paint either towards the docking unit 200 via the pipe 123 and via the coupling 122, or towards the circuit 20 via the coupling 121. The direction of the paint delivered by the accumulator 120 is selected by means of a selector valve 129.1 received in the end plate 127. The selector valve 129.1 can close off the couplings 121 and 122 in alternation and simultaneously. The selector valve 129.1 thus controls intake of paint into the accumulator 120 from the paint circuit 20, and discharge of paint from the accumulator 120 towards the pipe 123.

The pipes 123 and 153 that connect the base 220 to respective ones of the accumulators 110, 120, 130, 140, and 150 have relatively short lengths, thereby making it possible to minimize the head losses in the flow of the paint, and thus to limit the length of time necessary for re-supplying the reservoir 10 via the accumulator 120 or equivalent.

The station S operates using a re-supplying method of the invention. This method includes a step consisting in filling one or more accumulators 110, 120, 130, 140, and 150, as a function of the shades of paint selected for the next paint spraying cycles, this step being performed in masked time. For example, the accumulator 120 is filled with the paint that is contained in the circuit 20. The expression in "masked time" means that the step is performed as a background task concurrently with a paint spraying cycle, i.e. without slowing down the throughput rate of the painting installation.

In order to perform this filling, the pneumatic distributor valve is caused to go into discharge mode, so as to establish, inside the accumulator 120, a pressure that is less than the pressure prevailing in the duct 20. The thrust force $F_{120}$ is zero and the paint can enter the accumulator 120 by pushing back the piston 120.2. In this state, the pressure in the accumulator 120 is the same as the pressure in the circuit 20, namely typically 6 bars.

Then, the selector valve 129.1 is caused to "open" the coupling 121, so that paint flows from the duct 20 into the accumulator 120. Since the piston 120.2 does not resist intake of the paint into the accumulator 120, the accumulator 120 can be filled in masked time, during the paint spraying stage performed by the atomizer 1. When coating a vehicle body, the spraying stage lasts about 1 minute.

In order to fill the volume $V_{10}$ of the reservoir 10 completely, the volume $V_{120}$ of the accumulator 120 or equivalent must be greater than or equal to the volume $V_{10}$. For example, for a volume to be filled $V_{10}$ of 400 $cm^3$ it is possible to use an accumulator 120 having a volume $V_{120}$ of 600 $cm^3$, or indeed of 1000 $cm^3$.

After the accumulator 120 has been filled, the coupling 121 is "closed", by controlling the selector valve 129.1 in such a manner as to interrupt the fluid communication between the circuit 20 and the accumulator 120 or equivalent. The accumulator 120 is then isolated from the circuit 20.

Then the means for putting the volume $V_{120}$ under pressure are actuated: a pneumatic distributor valve feeds the thrust chamber 120.1 via the coupling 125 so as to increase the pressure prevailing in the accumulator 120 to a pressure significantly higher than the pressure of the circuit 20. When the thrust chamber 120.1 of the accumulator 120 is at a pressure of about 15 bars, the accumulator 120 is ready to deliver the paint it contains towards the docking unit 200 for the purpose of re-supplying the reservoir 10.

Thus, the coupling 125 and the thrust chamber 120.1 form means for putting the volume $V_{120}$ of the accumulator 120 or equivalent under pressure, to a pressure (15 bars) strictly greater than the pressure that prevails in the circuit 20 (6 bars).

At the end of a paint spraying cycle, after the step of filling the accumulator 120 or equivalent, the atomizer 1 is connected to the base 220, by moving the robot 2 and the deck 210 towards the plate 204. More precisely, the atomizer 1 and the base 220 are moved closer together until the plate 204 comes into contact on one side with the front portion 13 of the valve 12 and on the other side with the valve head 222.

The volume $V_{10}$ is brought to a pressure that is relatively low or zero, e.g. to atmospheric pressure. Then, the coupling 122 is "opened" so as to deliver paint into the pipe 123 and to the reservoir 10 via the docking unit 200.

When the reservoir 10 is filled, the atomizer 1 and the base 220 are disconnected and the robot disengages the atomizer 1 from the atomizer-receiving zone 250. The atomizer 1 thus leaves the station S so as to reach the paint spraying space.

At the end of a paint spraying cycle, the reservoir 10 equipping the atomizer 1 is partially or fully empty. It is then necessary to re-supply the reservoir 10 with paint, by filling it as described above. To this end, the robot 2 places the atomizer 1 in the atomizer-receiving zone 250. Prior to this, the device 251 is positioned at the head valve 222 corresponding to the accumulator 120 or equivalent that serves to transfer paint as a function of the selected shade. When the atomizer 1 is in the device 251, any paint residue is dumped from the reservoir 10. Said paint residue is collected by the device 251 and is then conveyed to a waste treatment center (not shown).

When the shade of paint is to be changed, the inside of the reservoir 10 is rinsed by means of a solvent duct (not shown) that can be connected to the plate 204. As is known per se, the device 251 uses solvent brought via the coupling 252 to clean the outside surfaces of the portion of the atomizer 1 that carries the atomizer member and that can thus have been soiled.

As described above, once the thrust chamber 120.1 has been put under pressure, and thus once the paint contained in the volume $V_{120}$ of the accumulator 120 has been put under pressure, the head valve 222 and the coupling 121 are "opened" via the selector valve 129.1, so that the paint flows from the accumulator 120 into the reservoir 10 via the pipe 123, thereby transferring the paint from the accumulator 120 towards the docking unit 200, and towards the reservoir 10.

The flow rate of this transfer from the volume $V_{120}$ to the volume $V_{10}$ depends on the pressure prevailing in the volume $V_{120}$ or equivalent. When the volume $V_{120}$ is put under 15 bars of pressure via the coupling 125, the flow rate of filling of the volume $V_{10}$ can reach 6000 $cm^3$/min throughout the stage of re-supplying the reservoir 10.

Such a filling flow rate makes it possible to fill a volume $V_{10}$ of 400 $cm^3$ in less than 5 seconds. This filling time, plus the time necessary for docking the atomizer 1, makes it possible to limit the total re-supply time necessary for re-supplying the atomizer 1 to less than 12 seconds. The "total re-supply time" means the length of time between stopping and resuming spraying paint onto the articles to be coated.

A station and a method of the present invention thus make it possible to achieve re-supply in a significantly shorter time than prior art stations and methods. The time necessary for changing shades is thus also shortened. Therefore, a station and a method of the present invention make it possible to achieve a spraying throughput rate of about 60 to 70 vehicles per hour.

In practice, the transfer pressure may lie in the range 10 bars to 30 bars, and the transfer flow rate may lie in the range 4000 $cm^3$/min to 6000 $cm^3$/min. In the present application, the pressures that are mentioned are pressures that are relative and static.

In order to regulate this pressure of 15 bars prevailing in the accumulator 120 or equivalent, and in the connection means such as the pipe 123 or 153, the station S also has at least one pressure sensor 208, shown diagrammatically in FIG. 5.

In a painting installation, the shade of paint to be sprayed onto each motor vehicle body is selected by a supervision unit. This supervision unit defines a wide variety of shade sequences, so that it is possible for a shade not to be selected for a relatively long time, during which the paint stagnates in one or more accumulators 110, 120, 130, 140, or 150.

In order to limit settling-out of said stagnant paint, a method of the invention further includes a step during which the paint stagnating in the accumulator 110, 120, 130, 140, or 150 is returned into the respective paint circuit after a length of time that is determined as a function of the characteristics of the paint.

In order to return paint in this way, the accumulator 120 or equivalent is connected to the circuit 20 by opening the coupling 121 by means of the selector valve 129.1. Since the volume $V_{120}$ is at a pressure, typically 15 bars, that is higher than the pressure, typically 6 bars, prevailing in the circuit 20, the paint flows from the accumulator 120 back into the circuit 20, until the volume $V_{120}$ has been fully emptied. This return thus limits stagnation of paint in the accumulator 120 or equivalent. Subsequently, it is possible to fill the accumulator 120 again, in the steps described above, so as to respond to a command from the supervision unit.

In a variant (not shown), instead of returning the paint via the coupling 121, a station of the invention may, for each accumulator, have a specific return coupling and a specific return duct, feeding of these specific elements being controlled by valves.

In addition, a station of the invention may, for each accumulator, have a "drain" circuit and a "drain" valve in order to collect the solvent that has flowed through the accumulator during the cleaning stage.

This reversible operation of the accumulators limits paint settling-out. Thus, a re-supply station of the invention may be connected to coating material circuits, each of which is made up of a single path for the "go" and "return" flows of the coating material. Nevertheless, a re-supply station of the invention may be connected to coating material circuits having two paths, namely a "go" path and a "return" path, that generally exist in a conventional painting installation.

In addition, a re-supply station of the invention does not need coating material circuits of greater dimensions because they are brought to usual pressures, of about 6 bars.

The structure of the station and the structure of the installation of which it is part are thus simpler than those of the prior art, thereby significantly reducing manufacturing, assembly, and maintenance costs.

In addition, in spite of the shade sequences that can be complex, a station and a method of the present invention improve the management of paints of different shades because the "rare" shades are handled by the versatile accumulator, and the "main" shades are handled by dedicated accumulators. This improved management of the various shades of paint also makes it possible to reduce wastage of coating material and of cleaning material.

The station S is shown with five dedicated accumulators. However, a re-supply station of the invention may have as many dedicated accumulators as there are "main" shades. For example, a re-supply station of the invention may have in the range one dedicated accumulator to thirty dedicated accumulators, and preferably sixteen accumulators.

In a variant (not shown), the means for putting the volume of each accumulator under pressure comprise a thrust chamber formed directly above the coating material. Such an accumulator is not provided with any piston and the compressed air then exerts its pressure directly on the coating material that it expels from the accumulator. Each accumulator then operates like a pot under pressure.

The invention claimed is:

1. A station for re-supplying coating material to at least one atomizer equipped with at least one reservoir and disposed on a robot that is mounted to move relative to the articles to be coated; the station including:

a docking unit defining an atomizer-receiving zone for receiving the at least one atomizer;

at least one accumulator having a volume greater than or equal to the volume of the reservoir;

a coupling means adapted to couple the at least one accumulator to at least one respective coating material circuit;

pressurizing means for putting the volume of the accumulator under pressure;

connection means for coupling the at least one accumulator to the docking unit; and a connection member for connecting the docking unit to the reservoir.

2. A station according to claim 1, wherein the station further includes a versatile accumulator connected to a plurality of circuits via coupling means that include a coating material change block, the versatile accumulator being connected firstly to the coating material change block and secondly to the docking unit.

3. A station according to claim 1, further including a plurality of accumulators, each of which is connected to a respective circuit via distinct coupling means, the connection member including, for each accumulator, a head valve configured for being connected to the atomizer.

4. A station according to claim 3, wherein the docking unit further includes a device for rinsing the outside surfaces of the atomizer; and at least one coupling member for coupling the device to at least one cleaning material duct, the device being mounted to move between a plurality of positions corresponding to the respective head valves.

5. A station according to claim 2, wherein the versatile accumulator is dedicated to the coating materials that are used least often, while each other accumulator is dedicated to a coating material that is used more often.

6. A station according to claim 1, wherein the at least one accumulator operates reversibly, so as to transfer coating material either towards the docking unit or towards the coupling means for coupling to the at least one respective coating material circuit.

7. A station according to claim 1, wherein the pressurizing means comprises a coupling and a respective thrust chamber belonging to the at least one accumulator, the thrust chamber being designed to be put under pressure in such a manner as to expel coating material from the corresponding accumulator, the coupling being adapted to connect the thrust chamber to a compressed air duct.

8. A station according to claim 7, wherein the pressurizing means comprises a respective piston being mounted to move in translation in the at least one accumulator the piston and a wall of at least one accumulator defining the thrust chamber.

9. A station according to claim 1, wherein the station further includes at least one pressure sensor for regulating the pressure prevailing in the at least one accumulator and in the connection means.

10. A method of re-supplying coating material to at least one atomizer equipped with at least one reservoir and disposed on a robot that is mounted to move relative to articles to be coated; the method comprising a) providing a station including:

a docking unit defining an atomizer-receiving zone for at least one atomizer;

at least one accumulator having a volume greater than or equal to the volume of the reservoir, the at least one accumulator being adapted to be connected to at least one respective coating material circuit via a coupling means;

connection means for connecting the at least one accumulator to the docking unit; and a connection member for connecting the docking unit to the reservoir;

b) filling the or each accumulator with coating material via the coupling means;

c) pressurizing the volume of the accumulator;

d) placing the atomizer in the atomizer-receiving zone;

e) connecting the reservoir to the docking unit;

f) transferring the coating material from one of the at least one accumulators to the docking unit so as to fill the reservoir.

11. A method according to claim 10, wherein the filling step b) consists in:

g) isolating the accumulator from the circuit by closing off the coupling means; and in h) performing the transfer at a transfer flow rate lying in the range 4000 cm3/min to 6000 cm3/min, the accumulator being put under a transfer pressure greater than the filling pressure prevailing in the circuit, the transfer pressure lying in the range 10 bars to 30 bars, and preferably being 15 bars.

12. A method according to claim 10, wherein the method further comprises the following steps:

i) prior to the placement step d), positioning a device for cleaning the outside surface of the atomizer at a head valve corresponding to the accumulator serving to perform the transfer step f); and j) essentially during the connection step e) and during the transfer step f), rinsing the outside surfaces of the atomizer by means of the device.

13. A method according to claim 10, wherein the method further comprises the following steps:

k) connecting the accumulator to the respective circuit by opening the coupling means; and l) returning into the corresponding circuit the coating material contained in an accumulator, after a length of time determined so as to limit settling-out of the coating material.

* * * * *